US007872204B2

(12) United States Patent
Lin

(10) Patent No.: US 7,872,204 B2
(45) Date of Patent: Jan. 18, 2011

(54) WATERTIGHT SWITCH

(75) Inventor: Wen-Lung Lin, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 1134 days.

(21) Appl. No.: 11/543,157

(22) Filed: Oct. 5, 2006

(65) Prior Publication Data

US 2008/0099315 A1 May 1, 2008

(51) Int. Cl.
*H01H 9/04* (2006.01)

(52) U.S. Cl. ..... 200/302.1; 200/302.2

(58) Field of Classification Search ..... 200/302.1, 200/302.2, 302.3

See application file for complete search history.

(56) References Cited

U.S. PATENT DOCUMENTS 6,774,327 B1 * 8/2004 Wong ..... 200/302.1
6,825,429 B2 * 11/2004 Dove et al. ..... 200/302.1
7,211,759 B2 * 5/2007 Chou ..... 200/461
7,235,755 B2 * 6/2007 Wang ..... 200/512

FOREIGN PATENT DOCUMENTS

TW 458358 A 10/2001
TW 515561 A 12/2002
TW 531036 A 5/2003

* cited by examiner

*Primary Examiner*—Renee S Luebke
*Assistant Examiner*—Lheiren Mae A Caroc
(74) *Attorney, Agent, or Firm*—Muncy, Geissler, Olds & Lowe, PLLC

(57) ABSTRACT

A watertight switch comprises a cover and a base assembled together to form an accommodating space for mounting a switching module therein. The cover and the base, at the combination interface therebetween, respectively have a first junction interface and a second junction interface, which are inwardly shrunk to form a binding gap, the binding gap is gummed by an adhesive for fixedly combining and positioning the first and the second junction interfaces, and the adhesive will fill the binding gap without flowing over the first and the second junction interfaces.

6 Claims, 5 Drawing Sheets

WATERTIGHT SWITCH

FIELD OF THE INVENTION

The present invention is related to a watertight switch, and more particularly to a watertight switch formed by a cover and a base, wherein a binding gap is inwardly formed at the junction interface between the cover and the base for gumming an adhesive so as to fix and position the junction interface between the cover and the base, and also, the binding gap can be filled by the adhesive.

BACKGROUND OF THE INVENTION

Currently, the conventional cases for the switch mostly adopt the assembling method as shown in FIG. 1, in which a tenon and a trough respectively on a cover and a base are employed to mutually engage with each other for assembling, and inside the case, an accommodating space will be formed for positioning the switching unit of the switch. However, the disadvantages are as followed. First, an interval between the tenon and the trough might cause a loose combination of the cover and the base. Second, an interval still might exist at the junction interface between the cover and the base so that moisture which may damage the conductor portion of the switching unit can easily get into the switch case. Third, the cost for molding the cooperated tenon and trough is high, which does not conform to the economic principle.

Therefore, FIG. 2 which shows a sectional drawing of a conventional switch provides another preferred method. As shown, an adhesive is adhered at the junction interface between the cover and the base for fixing thereof and simultaneously preventing the moisture from getting into the inner space so that the conductor portion of the switching unit may not be damaged thereby. Further, this method also benefit by the low cost. However, the adhesive actually has some disadvantages. Referring to the adhering portion shown in FIG. 2, because the adhesive is adhered to a flat plane, a leakage might be produced, so that except the adhesive is not easy to spread, the adhesive may also be extruded by the junction between the cover and the base so as to have an overflow inside or outside the case. If the leakage present at the outer surface of the switch, other components around the switch might be influenced, and if the leakage overflows into the inner portion of the switch, the switching unit therein might be significantly influenced, for example, the electric contact of the switching unit might be influenced, even be spoiled, so as to reduce the yield and also increase the cost.

References incorporated therein are R.O.C. Patent Publication Nos. 531036, 515561 and 458358, which all relate to switches utilizing an engaging portion for combining the cover and the base.

SUMMARY OF THE INVENTION

Therefore, the main object of the present invention is to solve the problems described above. The present invention provides a watertight switch which not only can prevent the sealed problem caused by assembling the tenon and the trough through adhering the cover and the base, but also can solve the overflow problem as assembling through the adhesive so that the cover and the base can be stably fixed without the adhesive flowing over.

The present invention provides a watertight switch which comprises a cover and a base assembled together to form an accommodating space for mounting a switching module therein. The cover and the base, at the combination interface therebetween, respectively have a first junction interface and a second junction interface, the first and the second junction interfaces are inwardly shrunk to form a binding gap, the binding gap is gummed by an adhesive for fixedly combining and positioning the first and the second junction interfaces, and the adhesive will fill the binding gap without flowing over the cover and the base.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
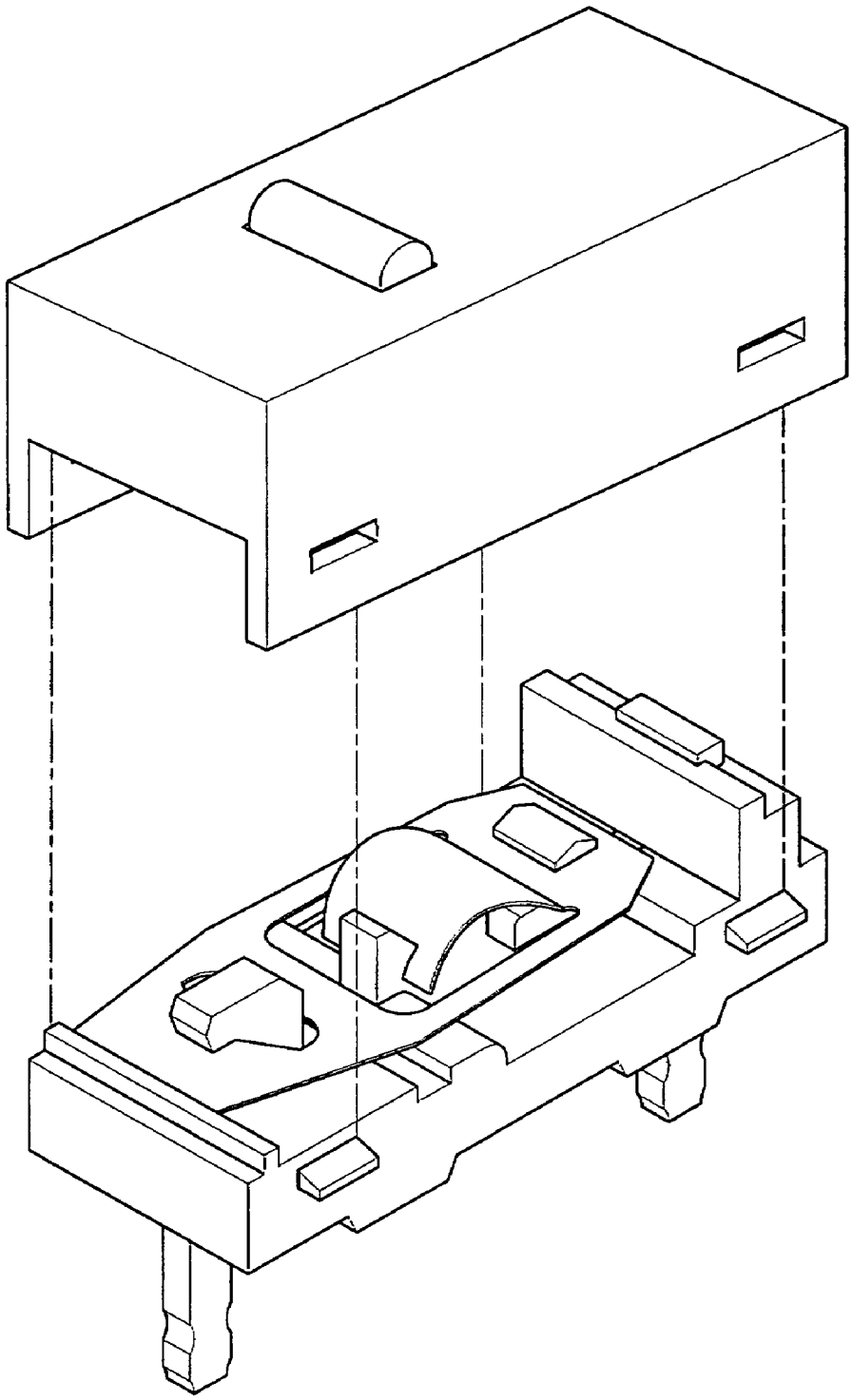
Fig. 1 PRIOR ART
FIG. 1 is a decomposition drawing showing the conventional switch.
Figure 2:
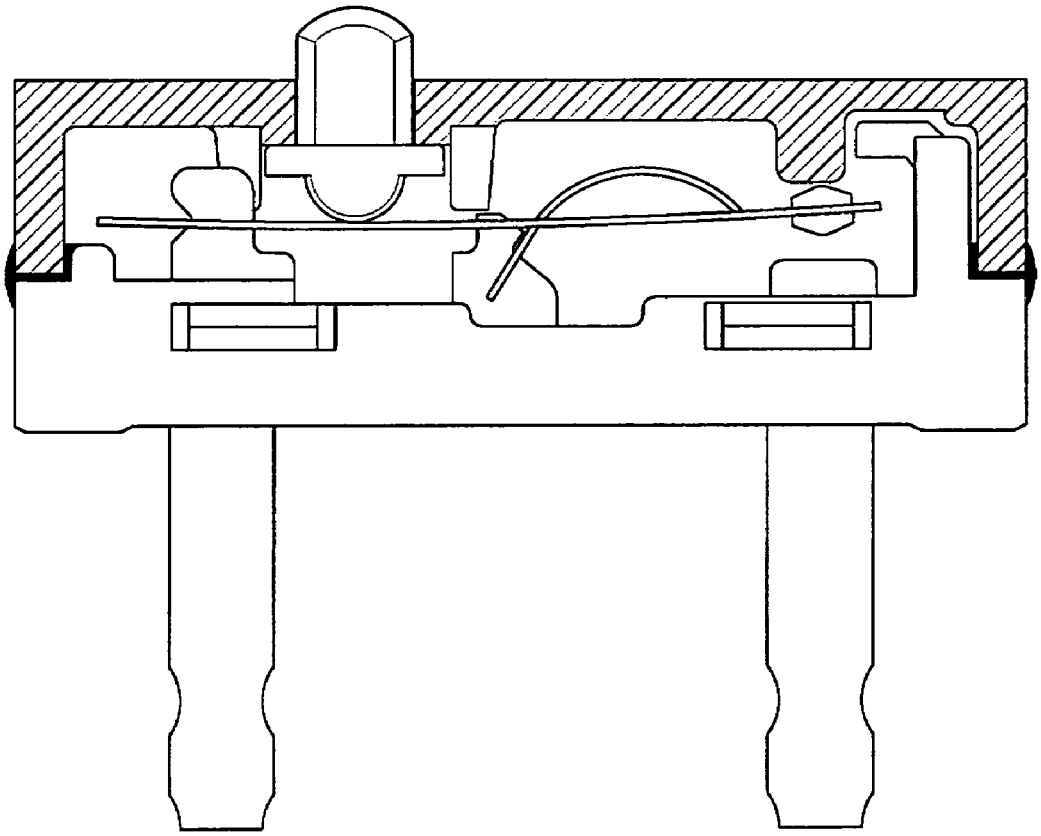
Fig. 2 PRIOR ART
FIG. 2 is a sectional drawing showing another conventional switch.
Figure 3A:
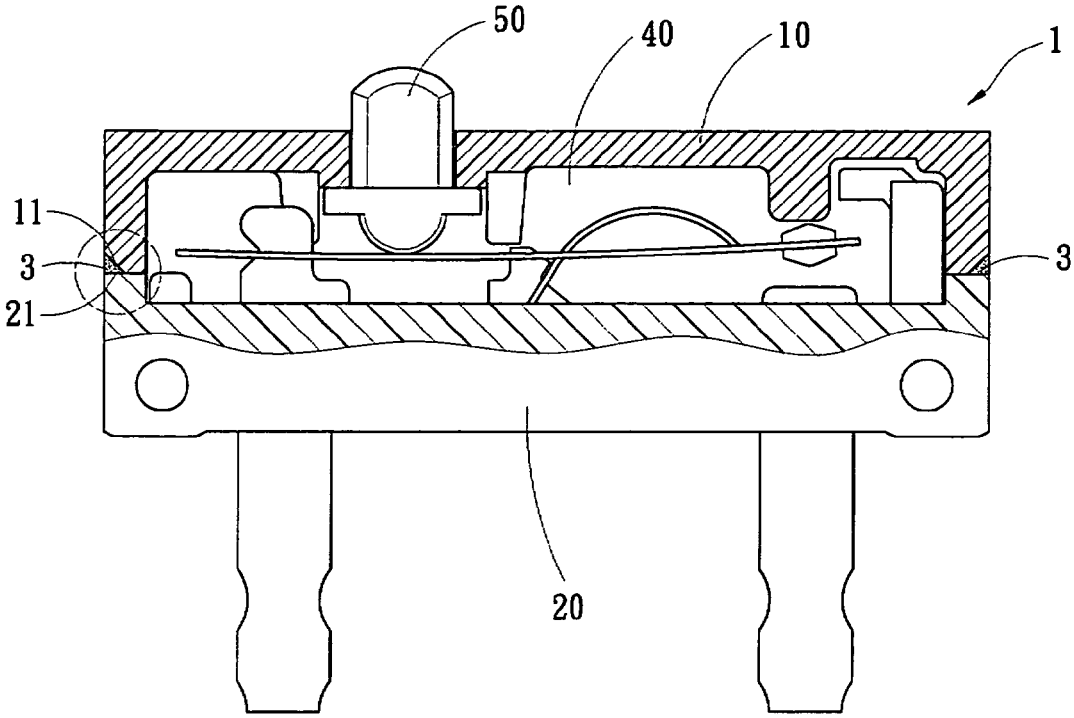
FIG. 3A shows a sectional drawing of the present invention.
Figure 3B:
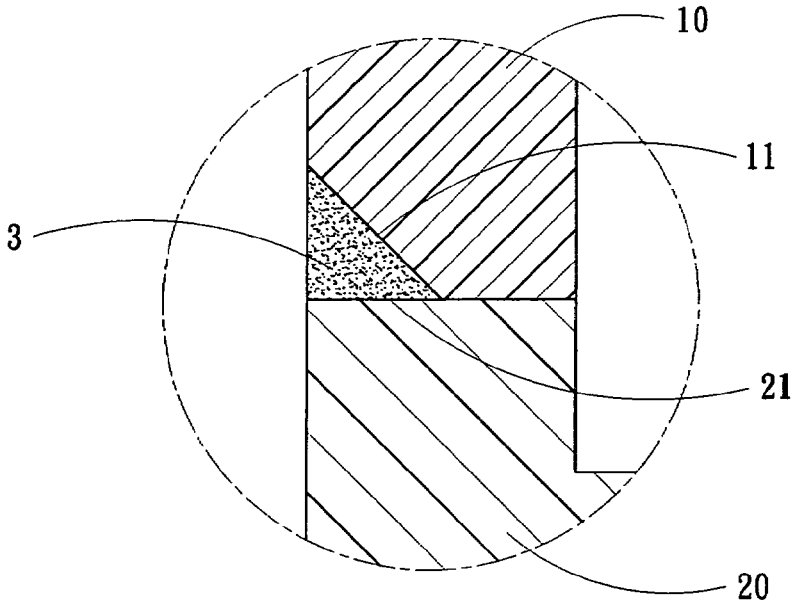
FIG. 3B shows a partial enlarged drawing of the present invention.

Please refer to FIG. 3A and FIG. 3B which are respectively a sectional drawing and a partial enlarged drawing of the present invention. The watertight switch 1 is assembled by a cover 10 and a base 20, wherein an accommodating space 40 is formed between the cover 10 and the base 20 for accommodating a switching module 50, which provides a conducting ability to the watertight switch. The cover 10 and the base 20 respectively have a first junction interface 11 and a second junction interface 21, wherein the first junction interface 11 is inwardly shrunk at an outer edge thereof to form a binding gap, and the binding gap can be gummed by an adhesive 3. When the cover 10 and the base 20 are assembled together, the adhesive 3 may fixedly position both the cover 10 and the base 20, and the overflowed adhesive 3 can fill the binding gap between the first junction interface 11 and the second junction interface 21 for forming the watertight switch and also sealing the gap between the cover 10 and the base 20 so as to protect the switching module 50 thereinside.

Figure 4:
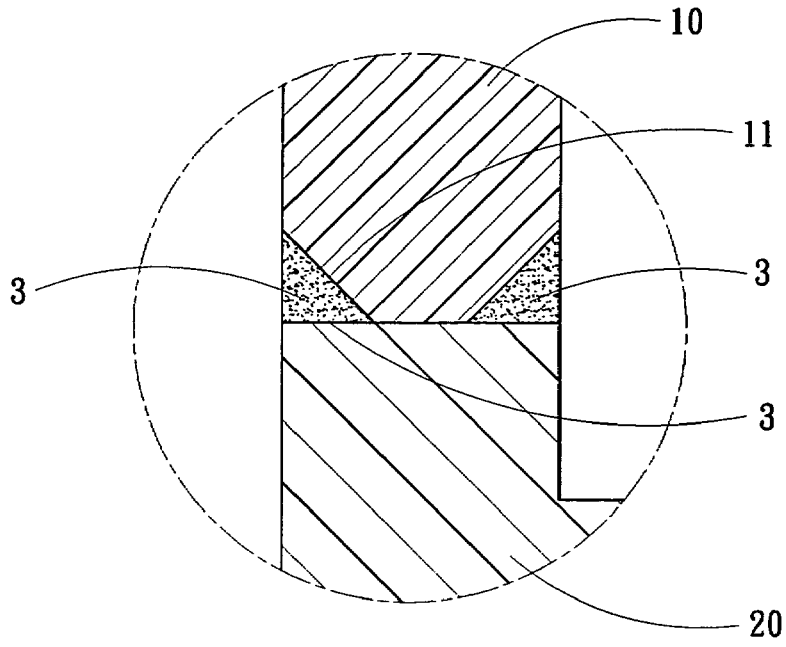
FIG. 4 is a schematic view showing a first embodiment of the present invention.
Figure 5:
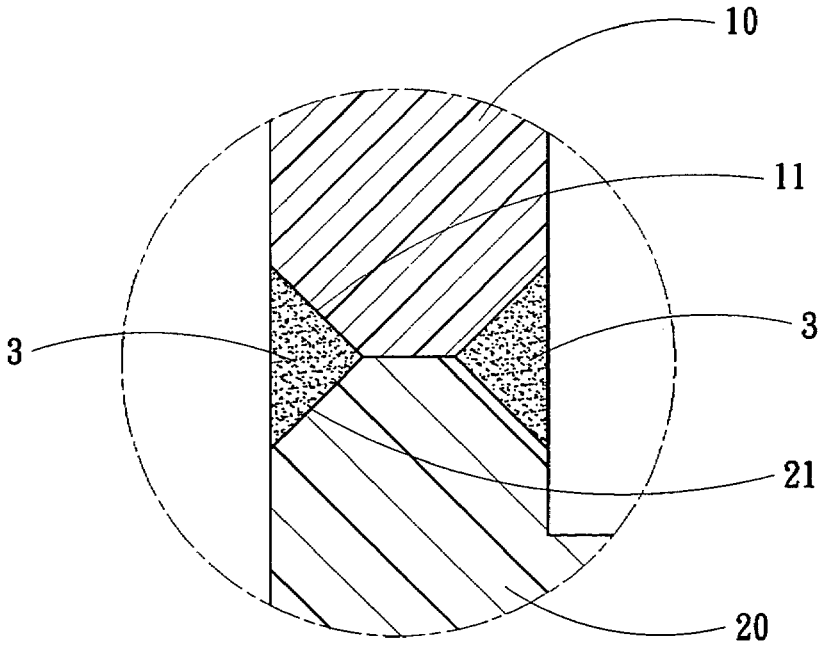
FIG. 5 is a schematic view showing a second embodiment of the present invention.
Figure 6:
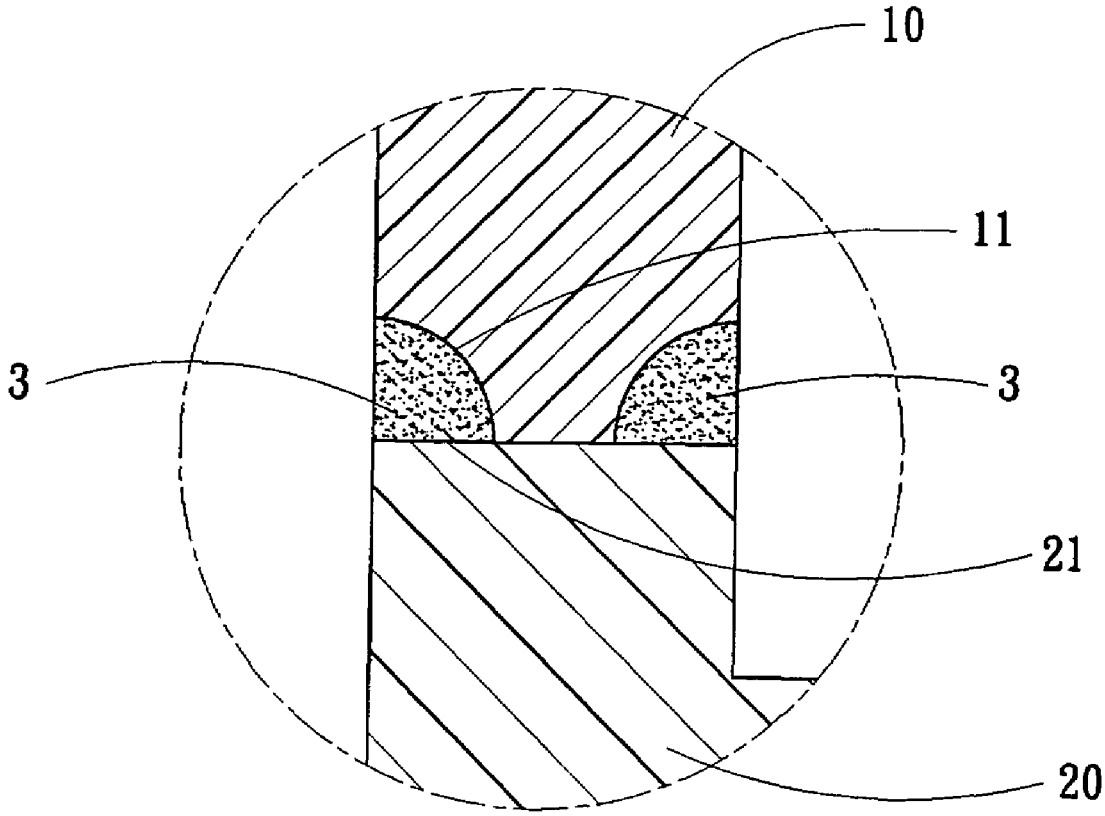
FIG. 6 is a schematic view showing a third embodiment of the present invention.

Please refer to FIGS. 4 to 6 which are schematic views respectively showing the first, the second and the third embodiments of the present invention. As shown in FIG. 4, the first junction interface 11 can be inwardly shrunk to form the binding gaps at both the outer and inner sides thereof, and identically, both the binding gaps can be gummed by the adhesive 3 for assembling the first junction interface 11 of the cover 10 with the second junction interface 21 of the base 20, and the overflowed adhesive also can fill the both gaps for smoothing the surface and providing the inner switching module 50 a double-layered protection (at the inner and the outer sides of the first junction interface 11). As shown in FIG. 5, except the first junction interface 11 of the cover 10, the second junction interface 21 of the base 20 also can be inwardly shrunk to form the binding gap for gumming the adhesive 3, so that the adhesive 3 may have a better fixing result between the cover 10 and the base 20 since the binding gap of the second junction interface increases the contact surface between the adhesive 3 and the second junction interface 21. Identically, the inner side of the base also can be inwardly shrunk to form the binding gap for improving the watertight and adhering abilities at the same time. As shown in FIG. 6, the inwardly shrunk binding gap of the first junction interface 11 or the second junction interface 21 can be formed to be an inclined plane, a fan shape, a rectangle or irregular shapes, and further, the binding gaps respectively on the cover 10 and the base 20 are not limited to employ identical shapes and also not limited to locate at an identical side.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A watertight switch, which comprises:

a cover and a base assembled together to form an accommodating space for mounting a switching module therein, wherein the cover and the base respectively have a first side surface and a second side surface, and at a combination surface between the cover and the base and extended from the first and second side surfaces, respectively has a first junction interface and a second junction interface which are correspondingly coupled together, borders between the first junction interface and the first side surface and between the second junction interface and the second side surface, at least one of the borders being inwardly shrunk to form a binding gap, the binding gap is gummed by an adhesive for fixedly combining and positioning the first and the second junction interfaces, and the adhesive fills the binding gap without flowing over the first and the second interfaces; and wherein the binding gap is located at the inner side of the switch between the first junction interface and the second junction interface.

2. The watertight switch as claimed in claim 1, wherein the cross-section of the binding gap between the first and the second junction interfaces is an inclined plane.

3. The watertight switch as claimed in claim 1, the cross-section of the binding gap between the first and the second junction interfaces is a geometric figure.

4. A watertight switch, which comprises:

a cover and a base assembled together to form an accommodating space for mounting a switching module therein, wherein the cover and the base respectively have a first side surface and a second side surface, and at a combination surface between the cover and the base and extended from the first and second side surfaces, respectively has a first junction interface and a second junction interface which are correspondingly coupled together, the borders between the first junction interface and the first side surface and between the second junction interface and the second side surface, at least one of the borders being inwardly shrunk to form a binding gap, the binding gap is gummed by an adhesive for fixedly combining and positioning the first and the second junction interfaces, and the adhesive fills the binding gap without flowing over the first and the second interfaces; and wherein the binding gap is located at both the outer side and the inner side of the switch between the first junction interface and the second junction interface.

5. The watertight switch as claimed in claim 4, wherein the cross-section of the binding gap between the first and the second junction interfaces is an inclined plane.

6. The watertight switch as claimed in claim 4, the cross-section of the binding gap between the first and the second junction interfaces is a geometric figure.

* * * * *